US006024435A

United States Patent [19]

Muraki

[11] Patent Number: 6,024,435

[45] Date of Patent: Feb. 15, 2000

[54] INK JET RECORDER

[75] Inventor: Motohito Muraki, Nagaya, Japan

[73] Assignee: Brother Kogyo Kabushiki Kaisha, Nagoya, Japan

[21] Appl. No.: 08/901,698

[22] Filed: Jul. 28, 1997

[30] Foreign Application Priority Data

Jul. 29, 1996 [JP] Japan ..... 8-199006

[51] Int. Cl.[7] ..... B41J 2/165

[52] U.S. Cl. ..... 347/32; 347/30; 347/29

[58] Field of Search ..... 347/32, 29, 30, 347/33, 35; 417/53

[56] References Cited

U.S. PATENT DOCUMENTS

| | | | |
|---|---|---|---|
| 5,184,147 | 2/1993 | MacLane et al. | 346/1.1 |
| 5,639,220 | 6/1997 | Hayakawa | 417/53 |
| 5,663,751 | 9/1997 | Holbrook | 347/22 |
| 5,670,997 | 9/1997 | Sugimoto et al. | 347/30 |

FOREIGN PATENT DOCUMENTS 6-126947 5/1994 Japan .

*Primary Examiner*—N. Le
*Assistant Examiner*—Shih-Wen Hsieh
*Attorney, Agent, or Firm*—Oliff & Berridge, PLC

[57] ABSTRACT

An ink jet recorder includes a head having ink ejection orifices, a cap for covering the orifices, a suction device for sucking ink from the head covered with the cap, a moving device for moving the cap with respect to the head, and a control device for controlling the moving and suction devices. In order to restore the ink jet head to its initial condition, the suction device is driven to suck the ink collecting between the cap and the head covered with the cap. Thereafter, the control device moves the cap by a slight distance, within the range where the cap is in close contact with the head, a plurality of times in such a direction that the cap retracts from the head. Each time the cap has moved by the distance, the suction device is driven. When the cap separates from the head, air is prevented from being entrained into the ink ejection orifices. Ink is prevented from spilling from the orifices.

21 Claims, 13 Drawing Sheets

INK JET RECORDER

BACKGROUND OF THE INVENTION

1. Field of the Invention

The present invention relates to an ink jet recorder in which the ink jet head is restored to its initial condition with a cap covering the ink ejection orifices of the head at a predetermined restoring position, and with a suction device sucking the residual ink in the head through the cap covering the orifices. In particular, the invention relates to an ink jet recorder in which it is possible to restore the ink jet head by sucking with a simple control mechanism the residual ink in the head, while maintaining the capping performance for the head over a long period of time by preventing degradation, permanent deformation, etc. of the cap even if the gap between the head and the cap varies with factors such as the irregularity in thickness of sheets of printing paper and the irregularity in dimensional precision of the cap and peripheral mechanisms.

2. Description of the Related Art

In a conventional ink jet recorder including an ink jet head, from which ink can be ejected onto a recording medium so as to record characters etc., it is possible to restore the head by covering the head with a cap at a predetermined restoring position, and then sucking and removing the residual ink in the head through the suction device communicating with the cap.

Japanese Patent Laid-Open Publication No. 6-126947, for example, discloses an ink jet recorder including an ink jet type recording head mounted on a carriage. Placed at the home position of the carriage is a capping unit including a cap for sealing the ink ejection orifices of the recording head. The capping unit is connected through a tube to a pumping unit. When the recording head cannot eject ink, the pumping unit is actuated to develop negative pressure in the cap for sucking ink through the ejection orifices of the recording head so as to restore the head.

If the cap of the capping unit was separated from the recording head immediately after the suction, atmospheric pressure would be applied instantaneously to the interior of the cap, in which negative pressure remains. This would cause a rapid change of pressure, which might break or destroy the menisci in the ink ejection orifices. As a result, air might be entrained into the orifices, causing defective ejection of ink. Furthermore, when the cap is separated, the residual ink in the cap might spill outside.

In order for these problems to be solved, in the ink jet recorder of the publication No. 6-126947, the carriage is first moved slightly when the ink ejection orifices of the recording head are sealed with the cap after the suction. This may form a slight gap between the recording head and the cap. Then, the pumping unit is actuated to suck ink and air. A gap is not necessarily formed between the head and the cap due to the irregularity in the cap size.

In some ink jet recorders, the recording head is positioned in accordance with the thickness of the recording medium so that the gap between the recording surface of the medium and the head is constant. Thus, the positioning of the recording head changes the gap between the head and the cap. In such cases also, a slight gap is not necessarily formed between the head and the cap.

Therefore, in the ink jet recorder of the publication No. 6-126947, the pumping unit is actuated to suck ink with the carriage moved slightly. Thereafter, the carriage is further moved slightly to a position where a gap is formed between the recording head and the cap. At the same time, ink is sucked through the pumping unit. Consequently, even if the dimensional precision etc. of the cap and peripheral mechanisms are irregular, air is prevented from being entrained into the ejection orifices by virtue of the gap formed between the head and cap. In addition, the ink in the cap can be sucked effectively so that it is possible to minimize the amount of ink remaining on or at the ink ejection surface of the recording head.

In the ink jet recorder disclosed in the publication No. 6-126947, slight movement of the carriage forms a gap between the recording head and the cap. As apparent from the drawings accompanying the publication, the slight movement of the carriage deforms the cap, which is made of rubber or the like, so as to form the gap between the head and the cap. Accordingly, the cap is deformed every time the recording head is restored. This may degrade and/or permanently deform the cap. If the cap degrades and/or permanently deforms, it is not possible to restore the recording head effectively.

Generally, in an ink jet recorder the recording head of which can be restored by suction, it is easier to control the printing and the restoration by suction independently or separately than together. Furthermore, in many cases, the independent controlling easily makes the controlling speed high.

In the ink jet recorder of the publication No. 6-126947, it is necessary to move the carriage slightly when the recording head is sucked for restoration. It is therefore necessary to control the carriage movement in addition to the restoration by suction. In such a case, it is difficult to control the restoration by suction simply, and to speed up the controlling.

SUMMARY OF THE INVENTION

In view of the foregoing conventional problems, it is an object of the present invention to provide an ink jet recorder in which degradation, permanent deformation, etc. of the cap are prevented so that the capping performance for the ink jet head is maintained over a long period of time even if the gap between the head and the cap varies with factors such as the irregularity in thickness of sheets of printing paper or another recording medium to be positioned opposite the head, and the irregularity in dimensional precision of the cap and peripheral mechanisms.

It is another object of the invention to provide such an ink jet recorder including a simple control mechanism which prevents air from being entrained into the ejection orifices of the ink jet head.

It is a further object of the invention to provide such an ink jet recorder in which it is possible to suck the residual ink in the ink jet head so as to restore the head to the initial condition.

In accordance with a first aspect of the invention, an ink jet recorder is provided which includes an ink jet head having ink ejection orifices formed therein. The orifices can be covered with a cap, which is connected to a suction device for sucking ink from the head covered with the cap. The cap can be moved by a moving device toward and away from the head. The moving and suction devices can be controlled by a control device in such a manner that the cap is positioned in a plurality of relative positions thereof with respect to the head, and the suction device is driven when the cap is positioned in each of the relative positions.

The operation of the ink jet recorder will be described below.

Before the ink jet head is restored to its initial condition, it is moved by a carriage, for example, which supports the head, to the position where it faces the cap. After the head is moved, the cap is moved toward the head by the moving device until it contacts closely with the head. Then, the suction device is driven by the control device so as to suck the ink collecting between the head and the cap. Thereafter, the control device so controls the moving and suction devices as to move the cap by a slight distance, within the range where the cap is in close contact with the head, in such a direction that the cap retracts from the head, and as to then drive the suction device. The cap movement by the slight distance and the suction device driving are performed at least once, and should preferably be repeated a plurality of times.

That is to say, the cap separates stepwise by the slight distance (little by little) from the ink jet head, and the head is sucked with the cap in various relative positions with respect to it. Accordingly, the cap does not abruptly separate from the head, and when the cap separates from the head, air is prevented from being entrained into the ink ejection orifices. In particular, in case that the gap between the head and the cap varies due to the irregularity in thickness of sheets of printing paper or another recording medium and/or the irregularity in size (dimensional precision) of the cap and peripheral mechanisms, it is difficult to predict a position in which the cap can cover the head and separate therefrom. Even in such a case, the cap can cover the head so securely that ink can be sucked, and the cap does not abruptly separate from the head. Because the cap separates from the head stepwise by the slight distance, ink is prevented from spilling from the ink ejection orifices.

During the suction for restoration, the carriage and the ink jet head held by it are not moved, as is the case with Japanese Patent Laid-Open Publication No. 6-126947. Accordingly, no stress develops which deforms the cap in the direction of movement of the carriage and the head. It is therefore possible to prevent the cap from degrading and deforming, and maintain the capping performance and the restoring performance for the head over a long period of time.

The control device may control the moving and suction devices in such a manner that air suction is performed after the cap is moved by the slight distance at least once in such a direction that it retracts from the ink jet head while kept in contact with the head and, when the cap has been moved by the distance, the suction device is driven.

The moving device may include a cam. In this case, the control device may be cam grooves formed in the cam for controlling, with the turning of the cam, the position of the cap and the drive timing of the suction device. The use of a cam enables a simple control device to change the relative position of the cap and drive the suction device.

The cam grooves may include a first cam groove for controlling the relative position of the cap with respect to the ink jet head. In this case, the ink jet recorder may further comprise a cap holder holding the cap. The holder includes a first cam follower in engagement with the first groove. As the cam turns, the first follower engaging with the first groove changes the relative position of the cap.

The cam grooves may further include a second cam groove for controlling the drive timing of the suction device. In this case, the suction device may include a suction pump with a piston. The suction device may further include a second cam follower connected to the piston and engaging with the second groove. As the cam turns, the second follower engaging with the second groove moves the piston to drive the pump. Because the two grooves are formed in the same cam, it is easy to adjust the relative position of the cap and the suction timing of the pump.

The ink jet recorder may further comprise a wiper for wiping the ink jet head. In this case, the cam may further have a fourth cam groove formed in it for controlling the relative position of the wiper with respect to the head. By forming the three grooves in the same cam, it is easy to adjust the relative position of the cap, the suction timing of the pump, and the wiping timing of the wiper.

In accordance with a second aspect of the invention, another ink jet recorder is provided which includes an ink jet head having ink ejection orifices formed therein. The orifices can be covered with a cap, which is connected to a suction device for sucking ink from the head covered with the cap. The relative position of the cap with respect to the head can be controlled in a plurality of steps by relative position control means. The suction device can be driven by a drive in each of the steps where the control means has controlled the relative position of the cap.

The relative position control means can stepwise control the relative position of the cap with respect to the ink jet head (the distance between the cap and head). The drive can drive the suction device in each step. It is therefore possible to reduce the distance of movement of the cap from the head. This can reduce the negative pressure developing when the cap separates from the head. It is consequently possible to reduce the amount of air entrained into the ink ejection orifices during the suction for restoration. It is also possible to prevent ink from spilling from the orifices when the cap separates from the head.

BRIEF DESCRIPTION OF THE DRAWINGS

A preferred embodiment of the present invention will be described below in detail with reference to the accompanying drawings, in which.

DETAILED DESCRIPTION OF THE EMBODIMENT

Figure 1:
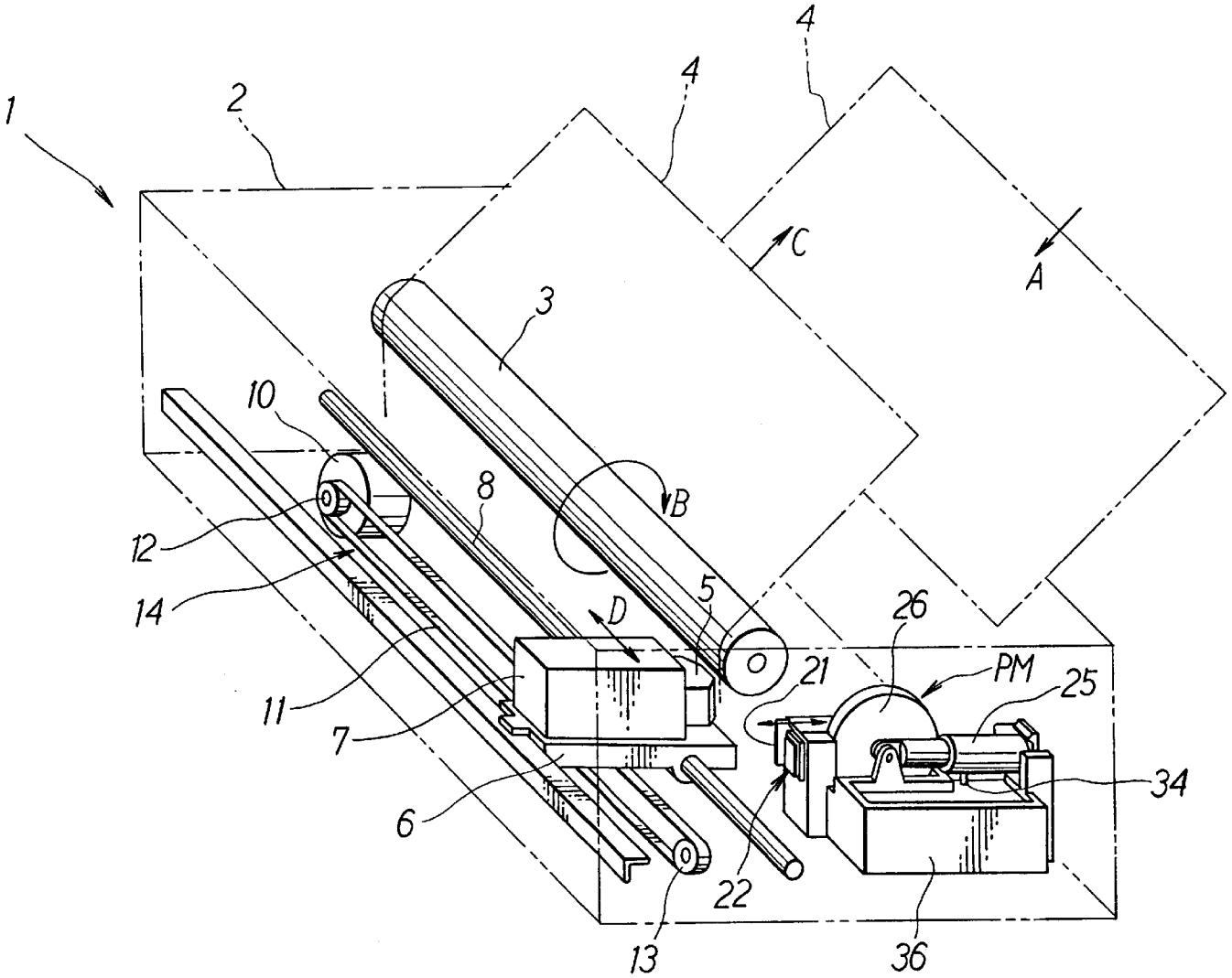
FIG. 1 is a perspective view schematically showing the overall structure of an ink jet printer according to the embodiment.

With reference to FIG. 1, the outline of an ink jet printer 1 according to the embodiment will be described first.

The printer 1 includes a frame 2, by which a cylindrical platen roller 3 is supported rotatably through a horizontal shaft (not shown). A sheet of printing paper 4 can be fed from a paper feed cassette (not shown) or a manual paper feed part (not shown). The fed sheet can be advanced or moved by the roller 3 while facing the ink jet head 5. The roller 3 forms part of the paper feeder.

A sheet of printing paper 4 can be fed in the direction A from a paper feed port (not shown), which is located at the rear of the frame 2. The fed sheet can be turned in the direction B by the rotation of the platen roller 3, and then discharged in the direction C through a paper discharge port (not shown).

A carriage guide rod 8 extends in parallel with the platen roller 3. A carriage 6 is supported on the rod 8 in front of the roller 3 slidably in the directions D along the roller 3. Mounted removably on the carriage 6 are an ink jet head 5 and an ink cartridge 7, which contains ink to be supplied to the head 5. The head 5 on the carriage 6 can thus reciprocate along the axis of the roller 3.

The carriage 6 can be reciprocated by a moving means including a belt drive 14, which consists of a belt 11 connected to the carriage 6 and a pair of pulleys 12 and 13. The belt 11 can be driven by a carriage drive motor 10, which may be a step motor or a DC motor.

A restoring area is located on the right of the platen roller 3 inside the frame 2. Installed in the restoring area is a restoring apparatus RM for rectifying defective or failed ejection of ink from the ink jet head 5. The head 5 may defectively eject ink due to the production of air bubbles in the head and/or the adhesion of ink drops to the ejection surface(nozzle surface) of the head during the use of the head. The restoring apparatus RM can restore the ejection to a good condition.

Figure 2:
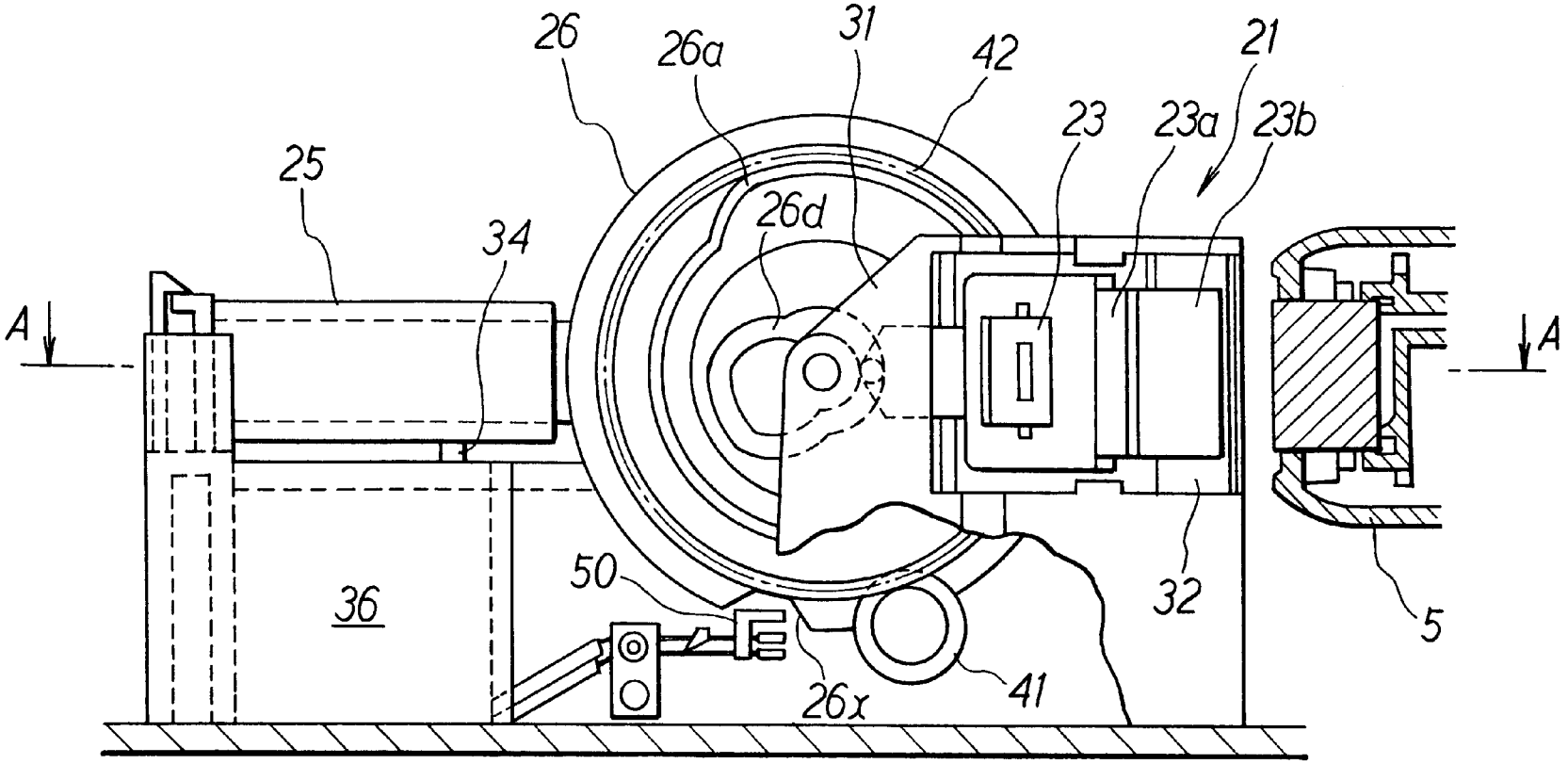
FIG. 2 is a partial cross section of the printer, showing the right sides of the wiper and other parts near the wiper of the printer shown in FIG. 1.
Figure 3:
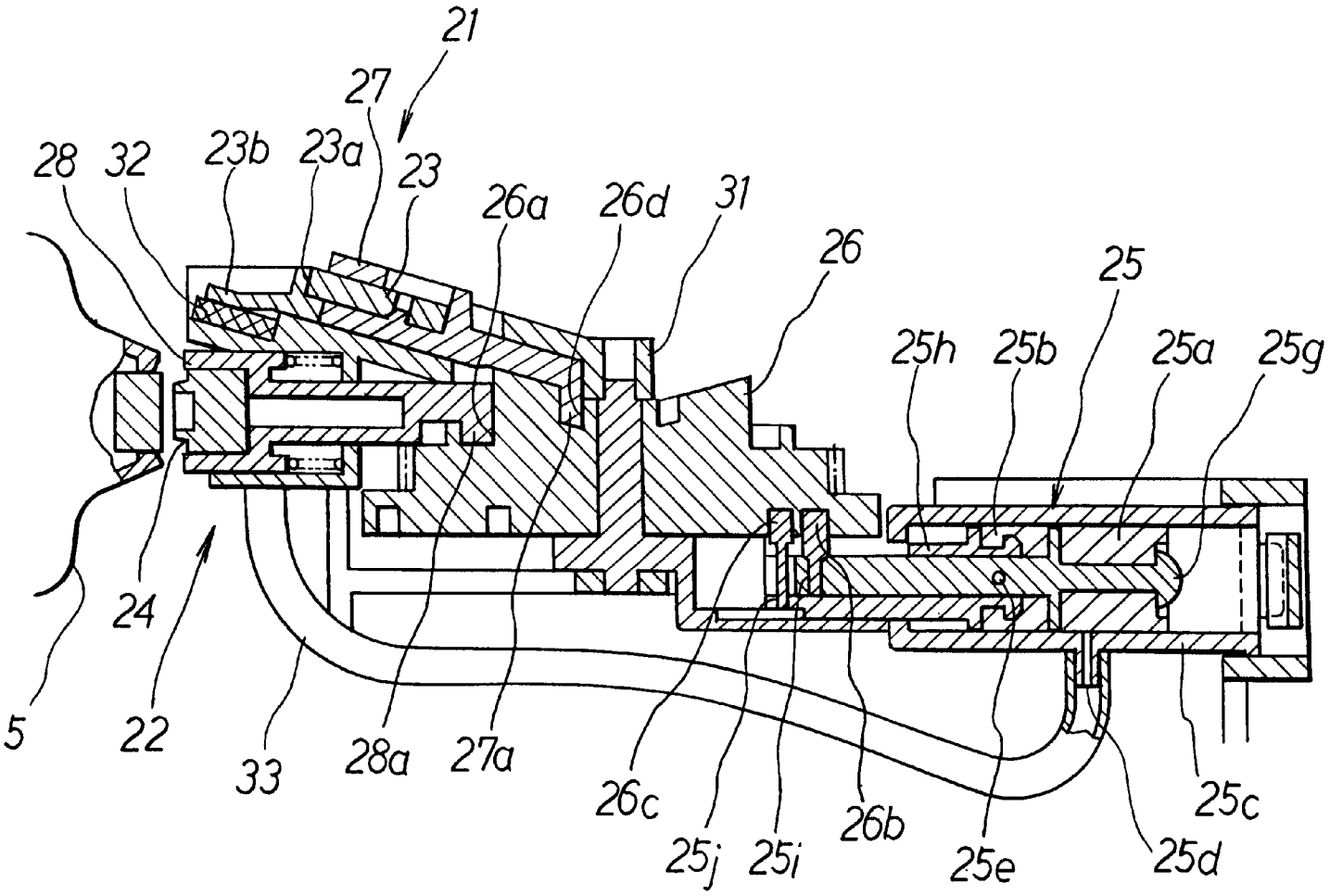
FIG. 3 is a cross section taken along line A—A of FIG. 2.
Figure 4A:
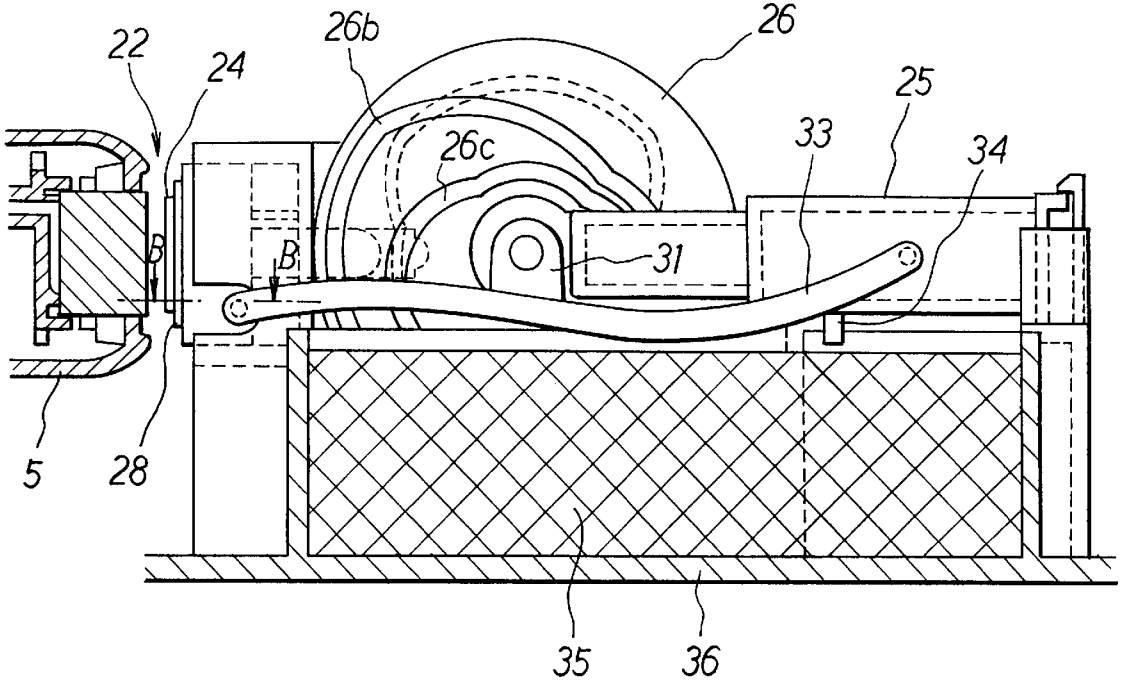
FIG. 4A is another partial cross section of the printer, showing the left sides of the wiper and other parts near the wiper.
Figure 4B:
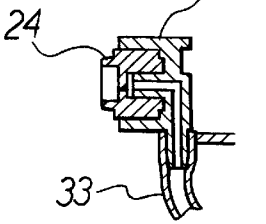
FIG. 4B is a cross section taken along line B—B of FIG. 4A.
Figure 5:
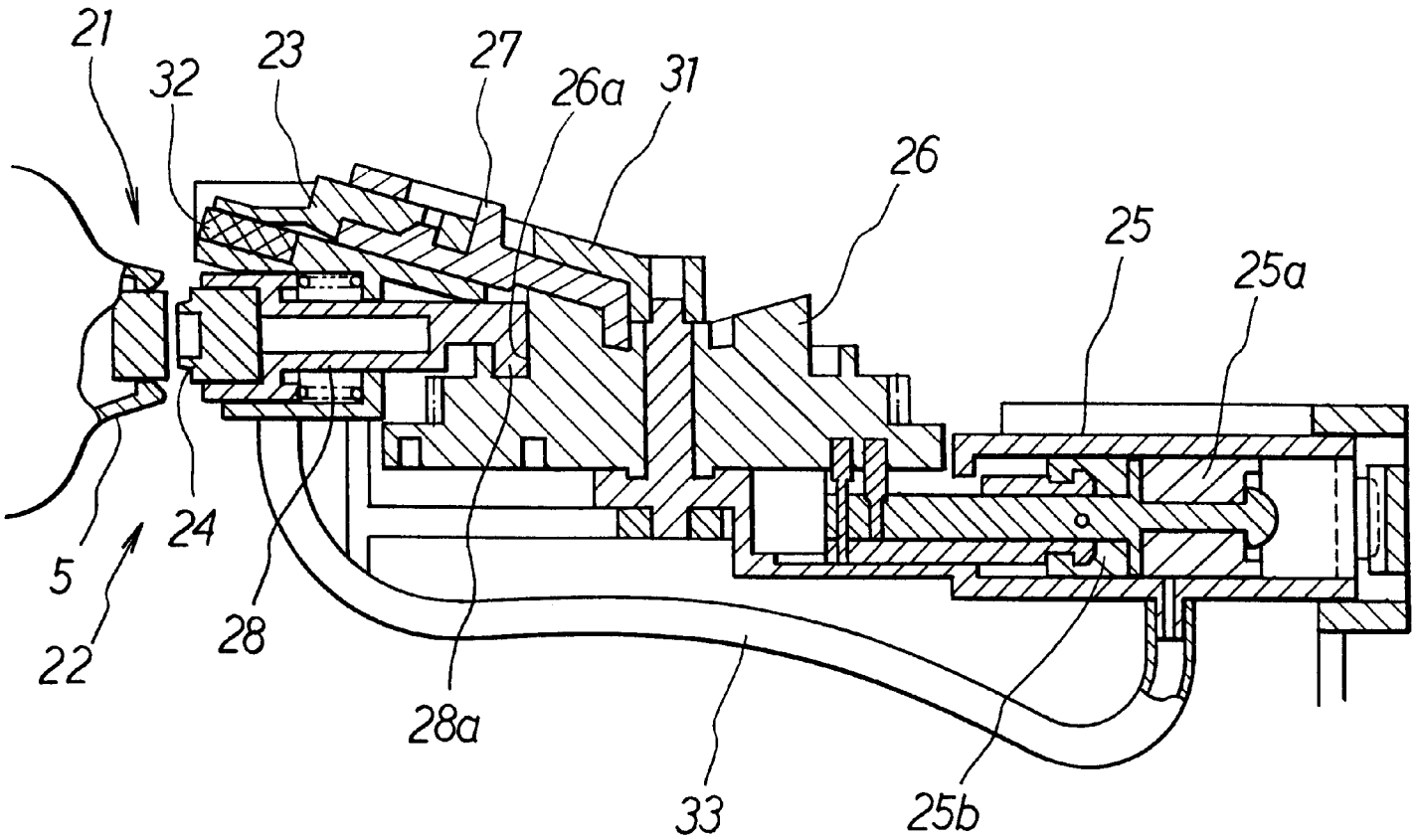
FIG. 5 is a view showing a step for restoring with the restoring apparatus of the printer, in which the wiper 23, the cap 24, and the pistons 25*a* and 25*b* of the suction pump 25 are in their waiting positions.

With reference to FIGS. 2–4, the structure of the restoring apparatus RM will be described.

The restoring apparatus includes a wiping device 21 for wiping the ejection surface of the ink jet head 5 and a purge device 22 for sucking the ink remaining in the head 5. The devices 21 and 22 are located near each other.

The wiping device 21 includes a wiper 23, which can reciprocate between a set position and a waiting position in a direction inclined with respect to the movement path of the ink jet head 5. In the set position, the wiper 23 is protruded into the path of the head 5 so as to wipe the ejection surface of the head. In the waiting position, the wiper 23 is retracted from the path of the head 5.

The purge device 22 includes a suction cap 24 for capping or covering the ink jet head 5. The cap 24 can move between a set position and a waiting position. In its set position, the cap 24 is protruded into the movement path of the head 5 so as to cap the ejection surface of the head. In its waiting position, the cap 24 is retracted from the path of the head 5. When the head 5 is covered with the cap 24, a suction pump 25 produces negative pressure for sucking through the cap 24 the residual ink in the head 5 so as to recover good ejection.

A common cam 26 controls the reciprocation of the wiper 23 of the wiping device 21, the reciprocation of the suction cap 24 of the purge device 22 and the driving of the suction pump 25.

The wiper 23 is held by a wiper holder 27, which is supported by a holder frame 31 in such a manner that it can reciprocate in the direction inclined with respect to the movement path of the ink jet head 5. The holder 27 has a cam follower 27*a* formed at its rear end, which is engaged with the fourth cam groove 26*d* of the cam 26.

Likewise, the suction cap 24 is held by a cap holder 28, which has a cam follower 28*a* formed at its rear end. The follower 28*a* is engaged with the first cam groove 26*a* of the cam 26.

The suction pump 25 includes a pair of a first piston 25*a* and a second piston 25*b*, which can be driven by drive shafts 25*g* and 25*h*, respectively. The shafts 25*g* and 25*h* have cam followers 25*i* and 25*j* formed at their respective front ends, which are engaged with the second and third cam grooves 26*b* and 26*c*, respectively, of the cam 26.

The turning of the cam 26 varies the engagement of the four grooves 26*a*–26*d* with the followers 28*a*, 25*i*, 25*j* and 27*a*, thereby controlling the reciprocation of the wiper 23 and cap 24 and the driving of the pump 25.

As stated later, the first cam groove 26*a* is so shaped as to stepwise change the relative position of the suction cap 24 with respect to the ejection surface of the ink jet head 5. The third cam groove 26*c* is so shaped that the second piston 25*b* makes a slight suction motion for each step of the change of the cam position.

The holder frame 31 is fitted with cleaning foam (waste liquid foam) 32 on that side of the movement path of the wiper holder 27 which is adjacent to the ink jet head 5. The foam 32 is made of porous ink absorbent, and can clean the wiper 23.

The wiper 23 includes a mounting part 23*a* and a flexible wiper blade 23*b* for wiping the ejection surface of the ink jet head 5. The blade 23*b* is fixed to the mounting part 23*a*, which is mounted on the wiper holder 27. When the wiper 23 is protruded, the blade 23*b* is nearly perpendicular to the movement path of the head 5. When the wiper 23 is retracted in the waiting position, the blade 23*b* bends in contact with the cleaning foam 32.

The suction cap 24 is connected through a suction tube 33 to the suction pump 25, to which one end of a discharge tube 34 is connected. The other end of the discharge tube 34 is connected to a waste ink tank 36 (FIG. 2), which houses an adsorbent 35. The residual ink in the nozzle of the ink jet head 5 can be sucked through the tube 33 by the pump 25. The sucked ink is discharged through the pump 25 and tube 34 into the tank 36, where it is adsorbed by the adsorbent 35.

As shown in detail in FIG. 3, the suction pump 25 includes a cylindrical casing 25*c* fixed to the holder frame 31. The pistons 25*a* and 25*b* can independently reciprocate in the casing 25*c*. The casing 25*c* has a suction port 25*d* and a discharge port 25*e* at a certain axial interval. The suction tube 33 and discharge tube 34 are connected to the ports 25*d* and 25*e*, respectively. The pistons 25*a* and 25*b* are coupled to and can be driven by the drive shafts 25*g* and 25*h*, respectively. The pistons 25*a* and 25*b* define a pump chamber 25*k* (FIG. 7) between them in the casing 25*c*. The shaft 25*g* extends slidably through the shaft 25*h*. As stated already, the shafts 25*g* and 25*h* are fitted with followers 25*i* and 25*j* on their respective front ends, which are engaged with the cam grooves 26*b* and 26*c*, respectively.

The cam 26 can be turned by a driving device, which includes the paper feeder drive motor, through a connecting member, which is connected to the driving device in such a manner that they can be disconnected from each other. Specifically, as shown in FIG. 2, the cam 26 has a gear 42 (connecting member) formed on its one side, which is engaged with a driving gear 41 in such a manner that the gears 41 and 42 can be disengaged from each other. The driving gear 41 is coupled to the driving device.

Figure 13:
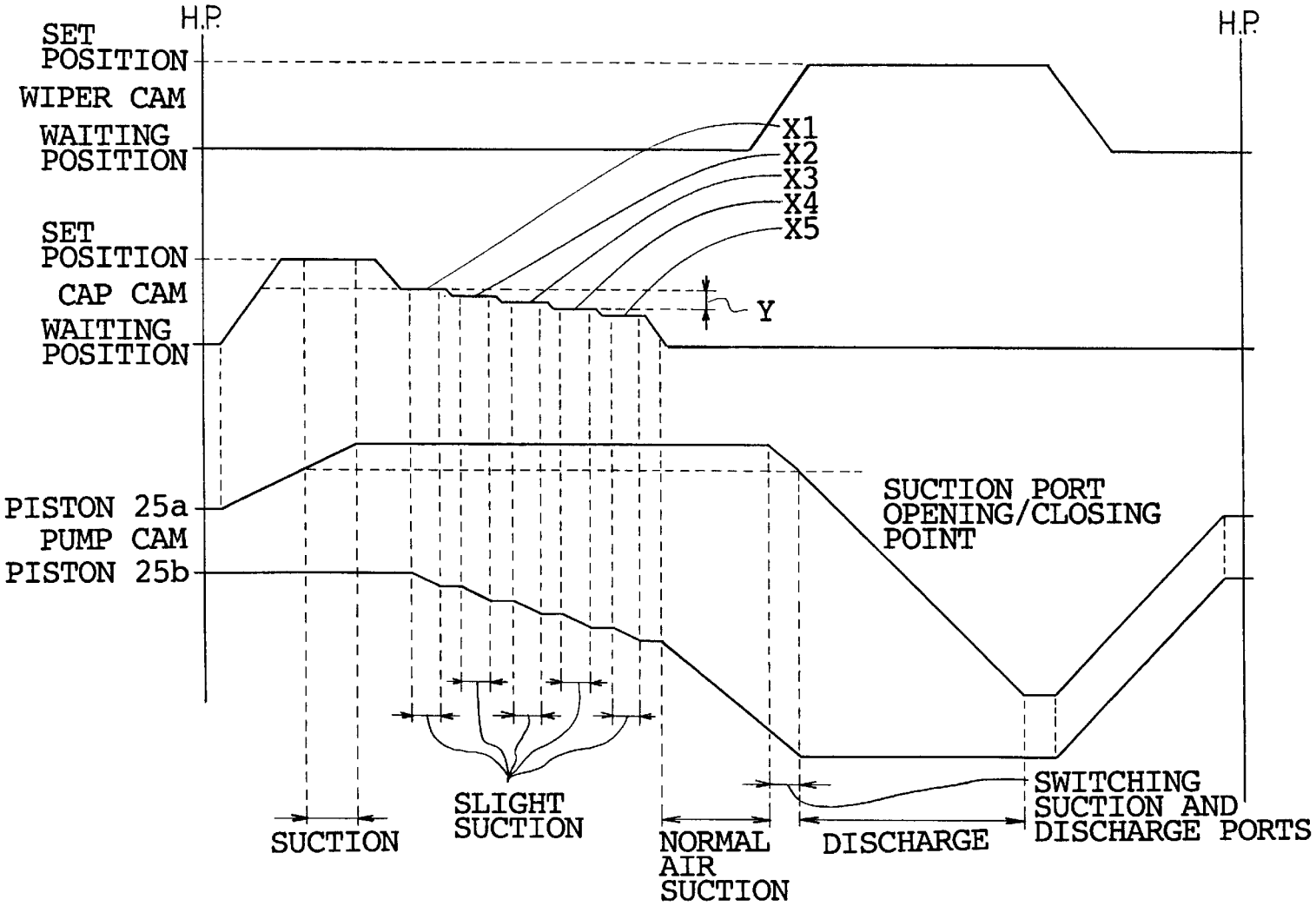
FIG. 13 is a cam diagram of the cam of the restoring apparatus.

With reference to FIGS. 5–13, the restoring operation of the restoring apparatus RM will be described below. FIG. 13 is a cam diagram of the fourth cam groove 26*d* for driving the wiper 23, the first cam groove 26*a* for driving the suction cap 24, and the second and third cam grooves 26*b* and 26*c* for driving the pump pistons 25*a* and 25*b*, respectively. For convenience, in FIG. 13, the wiper cam represents the fourth cam groove 26*d*, and the cap cam represents the first groove 26*a*. Likewise, the pump cams represent the second groove 26*b* and the third groove 26*c*.

For restoration of the ink jet head 5 to its good ejecting condition through the restoring apparatus RM, the carriage drive motor 10 is so controlled by a controller (not shown) as to move the carriage 6 to a home position, where the ejection surface of the head 5 faces the suction cap 24. At this stage, the wiper 23, the cap 24, and the pistons 25*a* and 25*b* of the suction pump 25 are in their waiting positions shown in FIG. 5.

Then, the cam 26 is turned to suck the ink remaining in the ink jet head 5. Because the cam follower 28*a* is engaged with the first cam groove 26*a*, the turning of the cam 26 moves the suction cap 24 forward from the waiting position to the protruded (set) position, where the cap 24 is in close contact with the ejection surface of the head 5 (FIG. 6).

Figure 6:
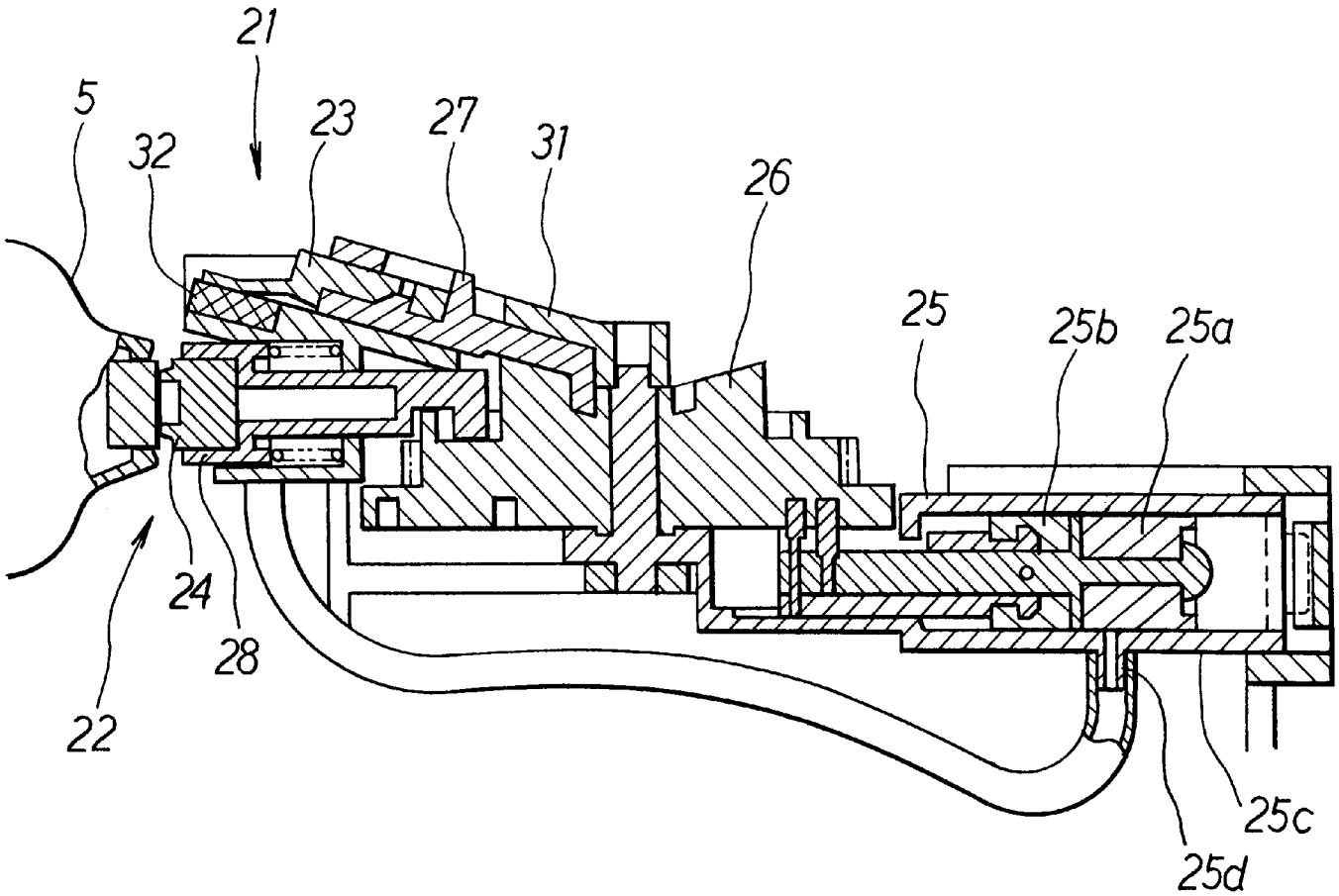
FIG. 6 is a view showing a step for restoring with the restoring apparatus of the printer, in which the cap 24 is in close contact with the ejection surface of the head 5.
Figure 7:
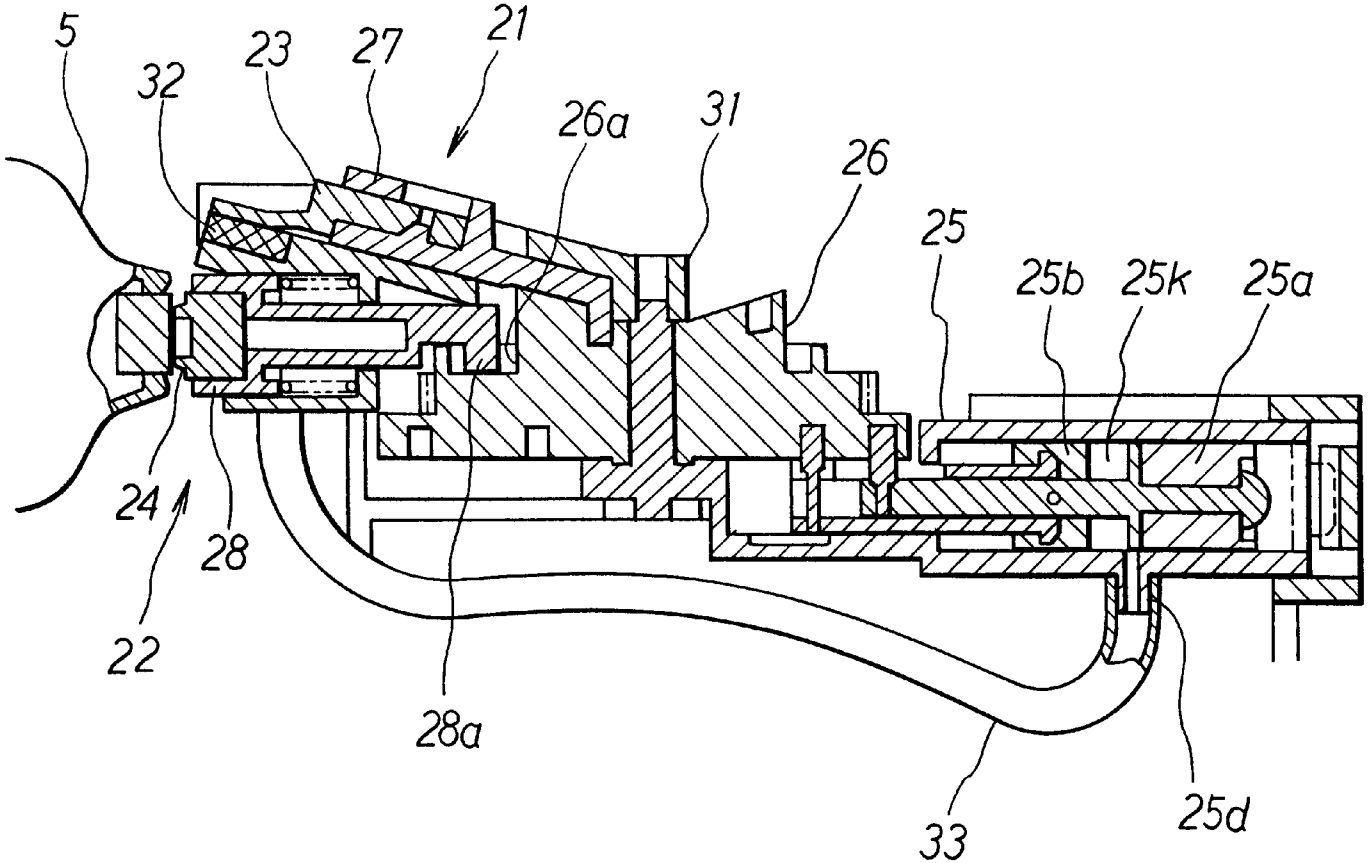
FIG. 7 is a view showing a step for restoring with the restoring apparatus of the printer, in which the first piston 25*a* is moved rearward while the second piston 25*b* is held stationary, increasing the volume of the pump chamber 25*k* defined therebetween.

At the same time that the suction cap 24 is moved forward, the turning of the cam 26 causes the cam follower 25*i* in engagement with the second cam groove 26*b* to move the first piston 25*a* rearward (to the right in FIG. 6). At the point of time (the point in FIG. 13 at which the suction port opens or closes) when the first piston 25*a* has just passed the suction port 25*d* of the pump casing 25*c*, the ink starts to be sucked. The ink is sucked until the first piston 25*a* is moved to the rear (right) end of its stroke. Thus, the driving of the suction pump 25 sucks the residual ink in the ink jet head 5 through the ejection surface of the head. Specifically, in the pump 25, only the first piston 25*a* is moved rearward while the second piston 25*b* is held stationary, increasing the volume of the pump chamber 25*k* defined between them (FIG. 7). This develops negative pressure in the chamber 25*k*, sucking the residual ink through the ejection surface, suction tube 33 and suction port 25*d* into the chamber 25*k*.

Subsequently, the cam 26 is turned by a predetermined angle from the position shown in FIG. 7. The turning of the cam 26 makes the first cam groove 26*a* (cap cam) and the cam follower 28*a* cooperate to retract the suction cap 24 to a first position X1 (FIG. 13). This changes the relative position of the cap 24 with respect to the ejection surface of the ink jet head 5 by a predetermined distance. At the same time that the cap 24 is thus retracted by the predetermined distance to the first position X1, the third cam groove 26*c* and the cam follower 25*j* in mutual engagement cooperate to move the second piston 25*b* forward (to the left in FIG. 7) by a slight distance, while the second groove 26*b* and the follower 25*i* in mutual engagement cooperate to stop the first piston 25*a*. Consequently, as apparent from the positional change of the second piston 25*b* shown in FIG. 13, this piston 25*b* makes a slight suction motion, sucking a slight amount of the residual ink through the ejection surface of the ink jet head 5.

Likewise, as shown in FIG. 13, slight turning of the cap cam 26 retracts the suction cap 24 to a second position X2, changing the relative position of the cap 24 with respect to the ejection surface of the ink jet head 5. At the same time, this turning moves the second piston 25*b* forward by another slight distance for a slight suction motion. Further turning of the cam 26 retracts the cap 24 to a third position X3, further changing the relative position of the cap 24 with respect to the ejection surface. At the same time, the second piston 25*b* is moved forward by still another slight distance for a slight suction motion. Still further turning of the cam 26 retracts the cap 24 to a fourth position X4, still further changing the relative position of the cap 24 with respect to the surface. At the same time, the piston 25*b* is moved forward by yet another slight distance for a slight suction motion.

The amount Y of the changes of relative positions of the suction cap 24 with respect to the ejection surface of the ink jet head 5 is the distance between the first position X1 and fourth position X4. The amount Y is determined with factors such as the irregularity in the gap between the head 5 and cap 24 due to the head positioning, the irregularity in the production and/or dimensional precision of the cap 24, and the irregularity in dimensional precision of the cap holder 28 and other peripheral mechanisms. Accordingly, when the cap 24 is between the positions X1 and X4, it may separate from the ejection surface of the ink jet head 5. In another case, when the cap 24 is in the position X4, it may be in contact with the ejection surface.

Figure 8:
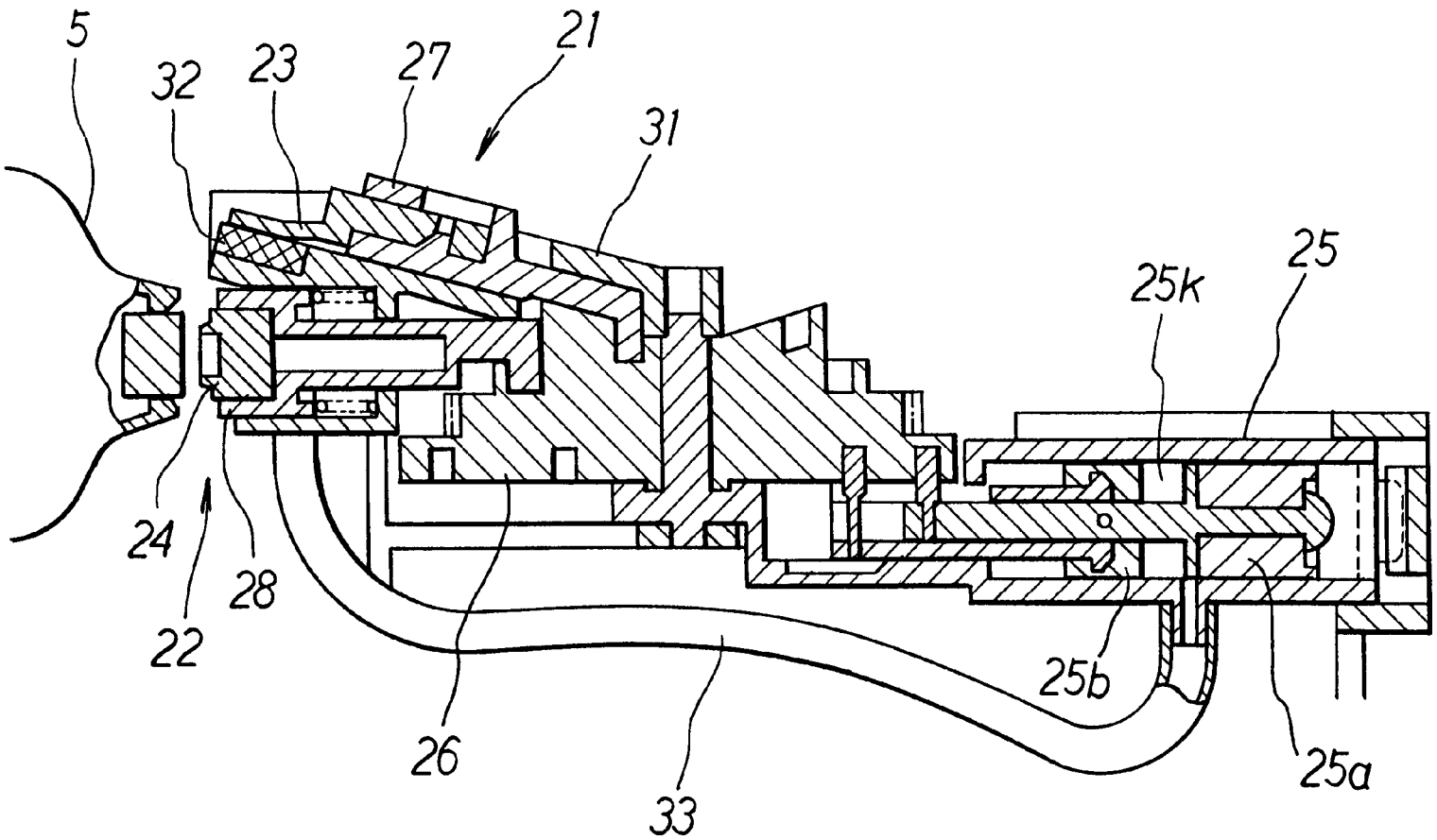
FIG. 8 is a view showing a step for restoring with the restoring apparatus of the printer, in which the cap 24 is spaced entirely from the ejection surface so as to be exposed to the atmosphere.

Likewise, the suction cap 24 is moved further to a fifth position X5 beyond the amount Y of the changes of relative positions of the cap 24. In this position X5, as shown in FIG. 8, the cap 24 is spaced entirely from the ejection surface so as to be exposed to the atmosphere. Then, the second piston 25*b* is moved by a slight distance to make a slight suction motion.

As stated already, the gap between the ink jet head 5 and suction cap 24 may vary with factors such as the irregularity in thickness of printing sheets 4 to be positioned opposite the ejection surface of the head 5 and the irregularity in dimensional precision of the cap 24 and peripheral mechanisms. In view of this possible variation, the turning of the single cam 26 stepwise (five steps) controls the relative position of the cap 24 with respect to the ejection surface, and causes the second piston 25*b* to make a slight suction motion for each step, on the basis of the engaging relations between the first cam groove 26*a* and cam follower 28*a*, between the second groove 26*b* and follower 25*i*, and between the third groove 26*c* and follower 25*j*. Accordingly, during this process, gap variation as stated above is absorbed (offset). This can reduce the distance of movement of the cap 24 and the residual negative pressure in the cap 24. Consequently, it is possible to prevent the ink from spilling from the ink ejection orifices of the head 5. It is also possible to restore the head 5 securely by reducing the amount of air entrained into the ink ejection orifices.

Figure 9:
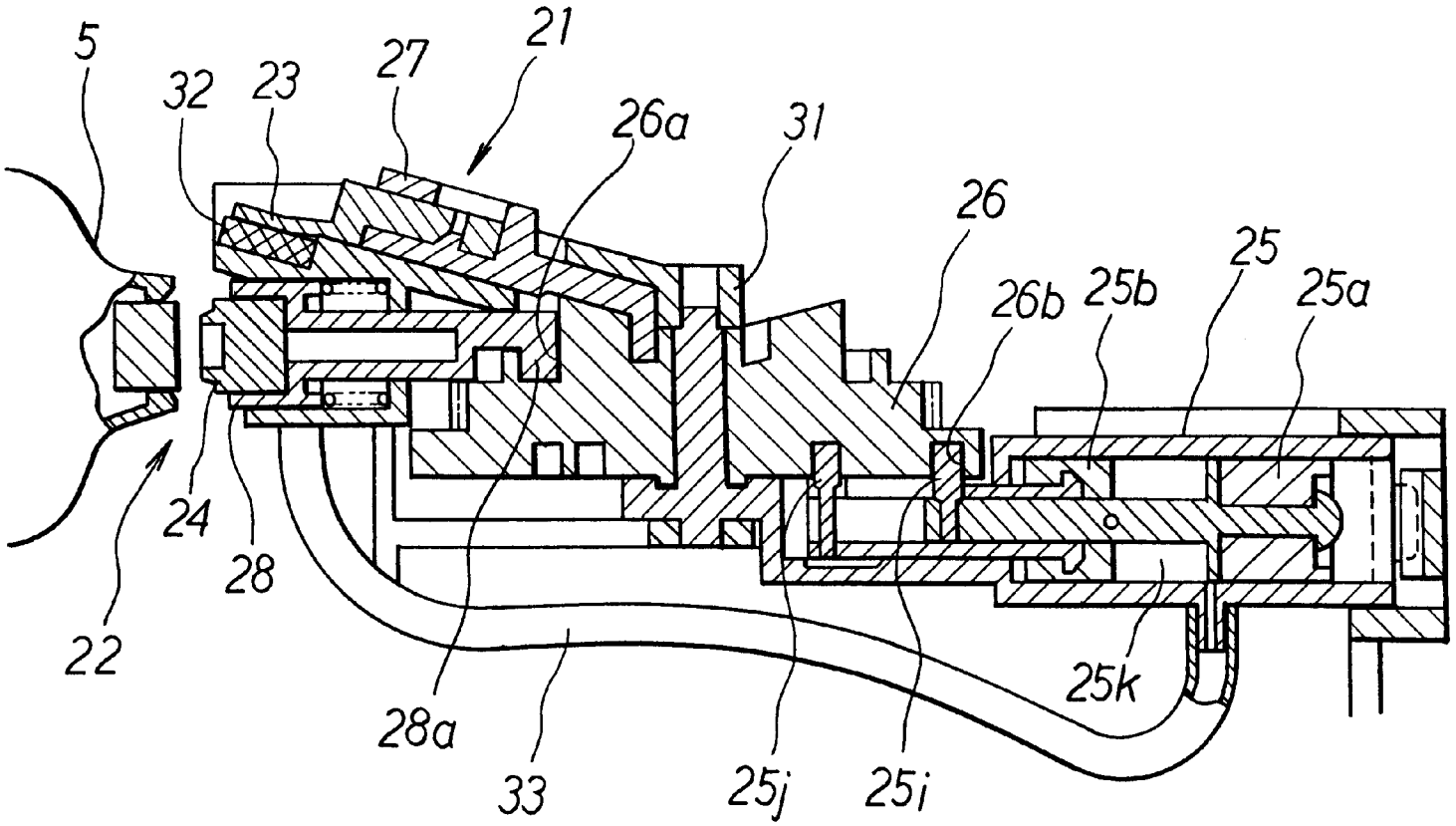
FIG. 9 is a view showing a step for restoring with the restoring apparatus of the printer, in which the ink remaining in the suction tube 33 is sucked into the chamber 25*k;*
Figure 10:
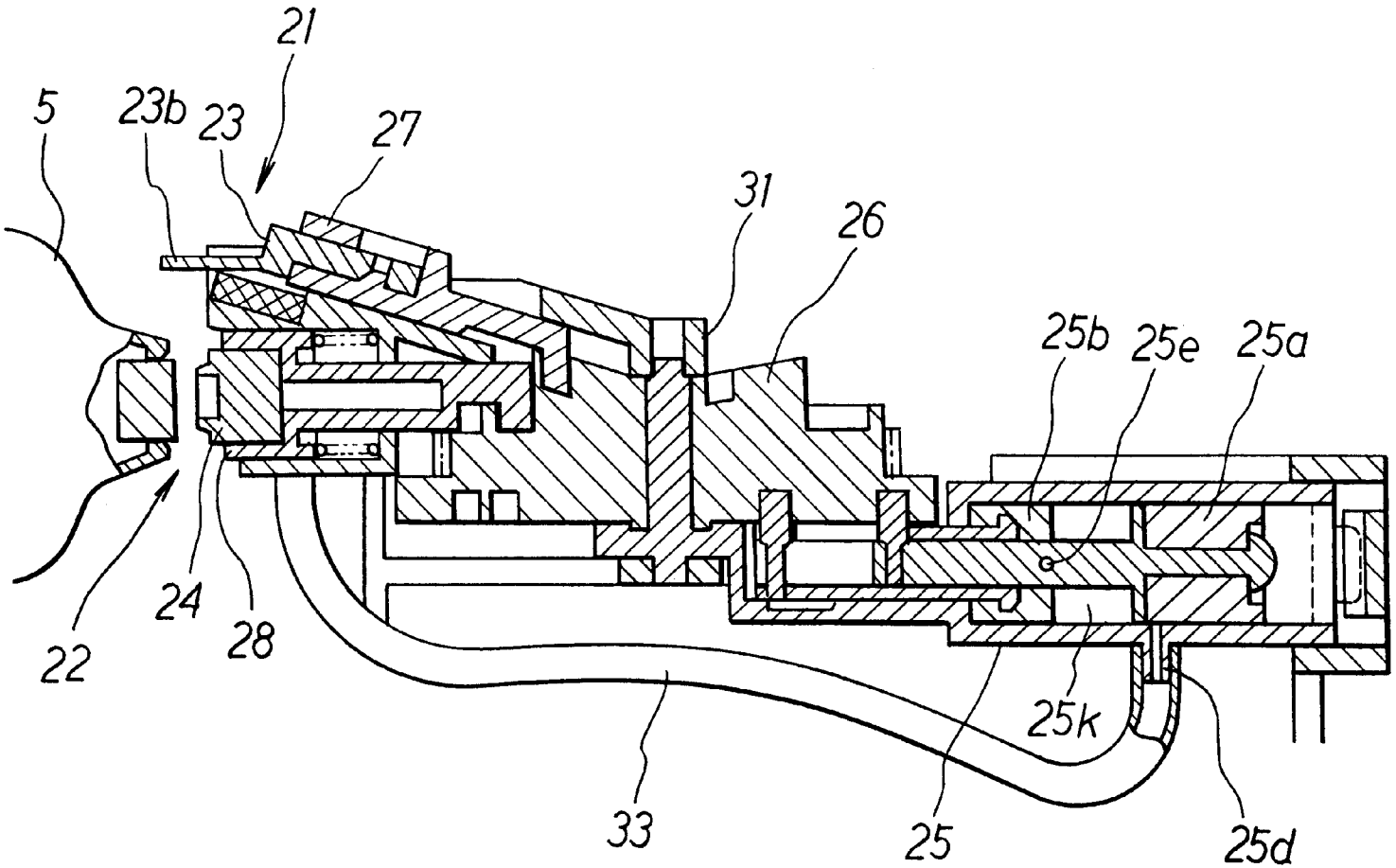
FIG. 10 is a view showing a step for restoring with the restoring apparatus of the printer, in which the pistons 25*a* and 25*b* of the suction pump 25 are moved forward until the suction port 25*d* of the pump 25 closes and the discharge port 25*e* opens.

After the restoration, the turning of the cam 26 returns the suction cap 24 to the waiting position (FIG. 13) through the engaging relation between the first cam groove 26*a* and cam follower 28*a*. Subsequently, similarly to the foregoing, with the first piston 25*a* stopped through the engaging relation between the second groove 26*b* and follower 25*i*, the second piston 25*b* is moved forward (left) through the engaging relation between the third groove 26*c* and follower 25*j*. This increases the volume of the pump chamber 25*k*, thereby performing air suction. Consequently, the ink remaining in the suction tube 33 etc. is sucked into the chamber 25*k* (FIG. 9).

Figure 11:
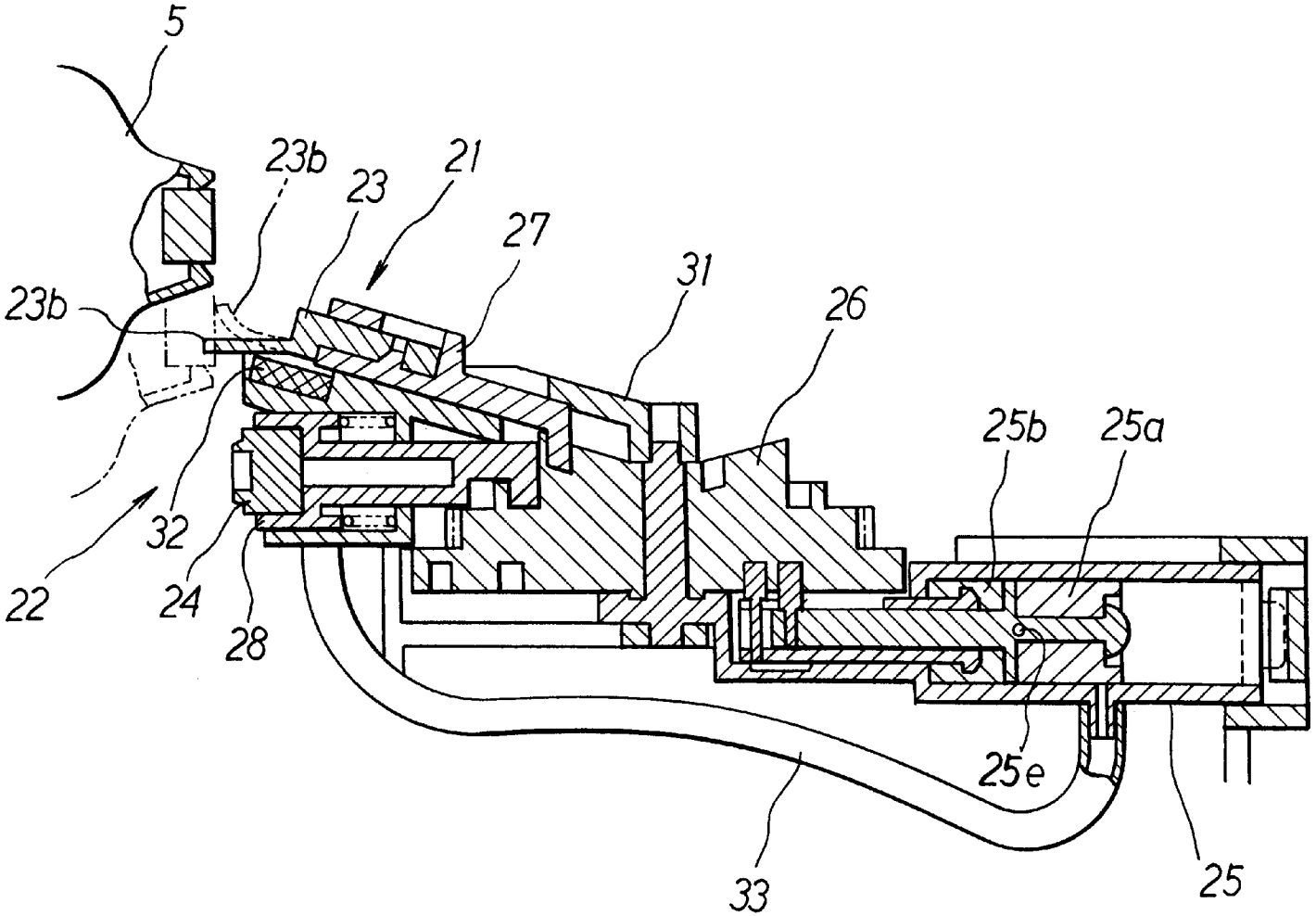
FIG. 11 is a view showing a step for restoring with the restoring apparatus of the printer, in which the ink sucked into the chamber 25*k* is discharging through the port 25*e* and wiper 23 wipes the ejection surface of the head 5.
Figure 12:
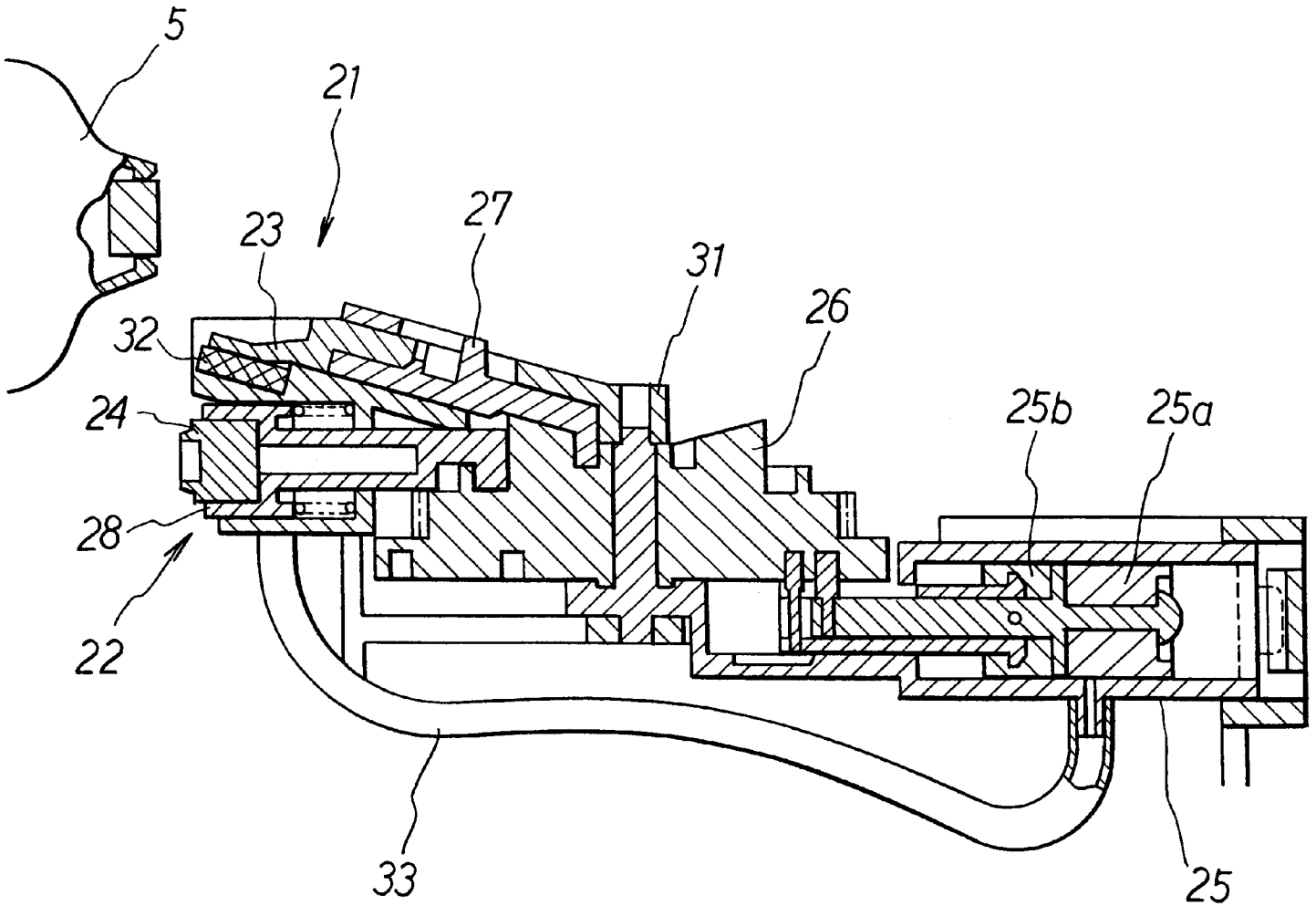
FIG. 12 is a view showing a step for restoring with the restoring apparatus of the printer, in which the cam returns to its initial condition.

After the series of suction steps through the suction cap 24, the turning of the cam 26 causes the fourth cam groove 26*d* and cam follower 27*a* in mutual engagement to cooperate to move the wiper 23 forward from its waiting position to its protruded position (the set position in FIG. 13) in the direction inclined with respect to the movement path of the ink jet head 5. At the same time, the pistons 25*a* and 25*b* of the suction pump 25 are moved forward until the suction port 25*d* of the pump 25 closes and the discharge port 25*e* (refer to FIG. 10 and the point in FIG. 13 at which the suction port opens or closes) opens. Then, as shown in FIG. 13, the second piston 25*b* is stopped while the first piston 25*a* is kept moving forward. This decreases the volume of the pump chamber 25*k*, discharging through the port 25*e* the ink sucked into the chamber 25*k* (FIG. 11). Because the volume of the chamber 25*k* decreases after the suction port 25*d* closes and the discharge port 25*e* opens, the ink is prevented from flowing back through the suction port 25*d*.

Then, the carriage 6 moves in such a direction that the ejection surface of the ink jet head 5 crosses the wiper 23. As a result, the wiper blade 23*b* wipes the ejection surface (FIG. 11), removing the foreign matter and excess ink on the surface.

At the end of a turn of the cam 26, the pistons 25*a* and 25*b* of the suction pump 25 have moved rearward, and the wiper 23 has retracted to its waiting position. At this stage, the switch 50 for detecting the rotational phase of the cam 26 is positioned in the notch 26*x* of the cam (see FIG. 2). This returns the cam 26 to its initial condition (FIG. 12), stopping it. The wiper 23 being now in the waiting condition, its surface which has wiped the ejection surface is in contact with the cleaning foam 32. This transfers the foreign matter to the surface of the foam 32 and makes the foam absorb the excess ink, removing the matter and ink adhering to the wiper 23. Consequently, the wiping performance is kept constantly good.

As described hereinbefore in detail, when the restoring apparatus RM restores the ink jet head 5, the suction cap 24 covers the ink ejection surface of the head 5. Under this condition, the turning of the single cam 26 controls the relative position of the cap 24 with respect to the ejection surface of the head 5 stepwise on the basis of the engaging relation between the first cam groove 26*a* and cam follower 28*a*. In each of the steps, the pistons 25*a* and 25*b* of the suction pump 25 cooperate, on the basis of the engaging relations between the second cam groove 26*b* and cam follower 25*i* and between the third groove 26*c* and follower 25*j*, to suck a slight amount of the residual ink in the head 5.

In order to change the positional relation between the head 5 and cap 24, the relative position of the cap 24 with respect to the head 5 is changed without the head 5 being moved. Therefore, while the relative position is changed, no such stress load as to deform the cap 24 is applied to it. This prevents degradation, permanent deformation, etc. of the cap 24, maintaining the capping performance for the head 5 over a long period of time.

The gap between the ink jet head 5 and suction cap 24 may vary with factors such as the irregularity in thickness of printing sheets 4 to be positioned opposite the ejection surface of the head 5 and the irregularity in dimensional precision of the cap 24 and peripheral mechanisms. In view of this possible variation, the turning of the single cam 26 stepwise (five steps) controls the relative position of the cap 24 with respect to the ejection surface, and causes the second piston 25*b* to make a slight suction motion for each step, on the basis of the engaging relations between the first cam groove 26*a* and cam follower 28*a*, between the second groove 26*b* and follower 25*i*, and between the third groove 26*c* and follower 25*j*. Accordingly, during this process, gap variation as stated above is absorbed (offset). This can reduce the distance of movement of the cap 24 and the residual negative pressure in the cap 24. Consequently, it is possible to prevent the ink from spilling from the ink ejection orifices of the head 5. It is also possible to restore the head 5 securely by reducing the amount of air entrained into the ink ejection orifices.

The single cam 26 can control the relative position of the suction cap 24 with respect to the ejection surface of the ink jet head 5, and perform the suction control of both pistons 25*a* and 25*b* in the suction pump 25. Therefore, the simple control mechanism can change the relative position of the cap 24 and drive the pump 25.

It should be understood that the invention is not limited to the embodiment. Of course, various improvements and/or modifications may be made without departing from the spirit and scope of the invention.

What is claimed is:

1. An ink jet recorder comprising:

an ink jet head having ink ejection orifices formed therein;

a cap for covering the orifices;

a suction device connected to the cap for sucking ink from the head covered with the cap;

a moving device for moving the entire cap toward and away from the head; and a control device for controlling the moving and suction devices in such a manner that the entire cap is positioned in a plurality of relative positions spaced from the jet head by the moving device in the direction of movement of the moving device, and the suction device is driven when the cap is positioned in each of the relative positions.

2. The ink jet recorder of claim 1, wherein the control device controls the moving and suction devices in such a manner that, after the suction device is driven with the cap in close contact with the ink jet head, the cap is moved by a slight distance in such a direction that the cap retracts from the head a plurality of times and, every time the cap has been moved by the distance, the suction device is driven.

3. The ink jet recorder of claim 1, wherein the control device controls the moving and suction devices in such a manner that, after the suction device is driven with the cap in close contact with the ink jet head, the cap is moved by a slight distance at least once in such a direction that the cap retracts from the head while kept in contact with the head and, when the cap has been moved by the distance, the suction device is driven.

4. The ink jet recorder of claim 3, wherein the control device further controls the moving and suction devices in such a manner that, after the steps of moving the cap by the slight distance and then driving the suction device, air suction is performed.

5. The ink jet recorder of claim 1, wherein the moving device includes a cam, the control device being cam grooves formed in the cam for controlling, with the turning of the cam, the position of the cap and the drive timing of the suction device.

6. The ink jet recorder of claim 5, wherein the cam grooves include a first cam groove for controlling the relative position of the cap with respect to the ink jet head, the recorder further comprising a cap holder holding the cap, the holder including a first cam follower in engagement with the first groove.

7. The ink jet recorder of claim 6, wherein the cam grooves further include a second cam groove for controlling the drive timing of the suction device, the suction device including a suction pump with a piston, the suction device further including a second cam follower connected to the piston, the second follower engaging with the second groove.

8. The ink jet recorder of claim 7, wherein the suction device changes the position of the piston in accordance with the relative positions of the cap with respect to the ink jet head.

9. The ink jet recorder of claim 6, wherein the cam grooves further include a second cam groove and a third cam groove for controlling the drive timing of the suction device, the suction device including a suction pump with a first piston and a second piston, the suction device further including a second cam follower and a third cam follower, which are connected to the first and second pistons, respectively, the second and third followers engaging with the second and third grooves, respectively, the pistons defining a reduced pressure space therebetween for suction.

10. The ink jet recorder of claim 9, wherein the suction device includes a suction port and a discharge port, the first piston opens or closes the suction port of the suction device, the second piston opening or closing the discharge port of the suction device.

11. The ink jet recorder of claim 9, wherein the suction device further includes a cylindrical casing, in which the first and second pistons can move coaxially.

12. The ink jet recorder of claim 5, further comprising a wiper for wiping the ink jet head, the cam further having a fourth cam groove formed therein for controlling the relative position of the wiper with respect to the head.

13. An ink jet recorder comprising:

an ink jet head having an ejection surface with ink ejection orifices formed thereon;

a cap for covering the orifices;

a suction device connected to the cap for sucking ink from the head covered with the cap;

relative position control means for controlling in a plurality of steps the movement of the entire cap relative to the head in a direction perpendicular to the ejection surface; and a drive for driving the suction device in each of the steps where the control means has controlled the relative position of the cap.

14. The ink jet recorder of claim 13, wherein the relative position control means and the drive are a cam.

15. The ink jet recorder of claim 14, wherein the cam has a first cam groove formed therein for controlling the relative position of the cap with respect to the ink jet head, the recorder further comprising a cap holder holding the cap, the holder including a first cam follower in engagement with the first groove.

16. The ink jet recorder of claim 15, wherein the cam further has a second cam groove formed therein for controlling the drive timing of the suction device, the suction device including a suction pump with a piston, the suction device further including a second cam follower connected to the piston, the second follower engaging with the second groove.

17. The ink jet recorder of claim 16, wherein the suction device changes the position of the piston in accordance with the relative positions of the cap with respect to the ink jet head.

18. The ink jet recorder of claim 16, further comprising a wiper for wiping the ink jet head, the cam further having a fourth cam groove formed therein for controlling the relative position of the wiper with respect to the head.

19. The ink jet recorder of claim 15, wherein the cam further has a second cam groove and a third cam groove formed therein for controlling the drive timing of the suction device, the suction device including a suction pump with a first piston and a second piston, the suction device further including a second cam follower and a third cam follower, which are connected to the first and second pistons, respectively, the second and third followers engaging with the second and third grooves, respectively, the pistons defining a reduced pressure space therebetween for suction.

20. The ink jet recorder of claim 19, wherein the suction device includes a suction port and a discharge port, the first piston opens or closes the suction port of the suction device, the second piston opening or closing the discharge port of the suction device.

21. The ink jet recorder of claim 19, wherein the suction device further includes a cylindrical casing, in which the first and second pistons can move coaxially.

* * * * *